US008801229B2

(12) United States Patent
Hsu et al.

(10) Patent No.: US 8,801,229 B2
(45) Date of Patent: Aug. 12, 2014

(54) ILLUMINATING DEVICE CAPABLE OF WATERPROOF FUNCTION AND HEAT-DISSIPATING FUNCTION

(75) Inventors: Feng-Ting Hsu, Taipei (TW); Ming-Cheng Hua, Taipei (TW)

(73) Assignee: Everlight Electronics Co., Ltd., New Taipei (TW)

( * ) Notice: Subject to any disclaimer, the term of this patent is extended or adjusted under 35 U.S.C. 154(b) by 113 days.

(21) Appl. No.: 12/976,961

(22) Filed: Dec. 22, 2010

(65) Prior Publication Data

US 2011/0149576 A1 Jun. 23, 2011

(30) Foreign Application Priority Data

Dec. 23, 2009 (TW) ..... 98144534 A

(51) Int. Cl.
*F21V 29/00* (2006.01)

(52) U.S. Cl.
USPC ..... 362/294; 362/257; 362/260; 362/92

(58) Field of Classification Search
None
See application file for complete search history.

(56) References Cited

U.S. PATENT DOCUMENTS

| | | | | |
|---|---|---|---|---|
| 6,472,823 | B2 * | 10/2002 | Yen | 315/112 |
| 7,288,796 | B2 * | 10/2007 | Dry | 257/88 |
| 2002/0125839 | A1 | 9/2002 | Yen | |
| 2005/0189554 | A1 | 9/2005 | Dry | |
| 2007/0090737 | A1 | 4/2007 | Hu et al. | |

FOREIGN PATENT DOCUMENTS

| | | |
|---|---|---|
| CN | 2842199 | 11/2006 |
| CN | 2886342 | 4/2007 |
| CN | 101392874 | 3/2009 |
| CN | 101403488 | 4/2009 |
| JP | 2006-251750 | 9/2006 |
| TW | M314827 | 7/2007 |
| TW | M351302 | 2/2009 |
| TW | M355341 | 4/2009 |
| TW | M363551 | 8/2009 |
| TW | M367290 | 10/2009 |
| WO | 2007093607 | 8/2007 |
| WO | 2010140171 | 12/2010 |

OTHER PUBLICATIONS

"Search Report of European Counterpart Application", issued on Mar. 23, 2011, p. 1-p. 6.
"Search Report of European Counterpart Application", issued on Jul. 29, 2011, p. 1-p. 7.

* cited by examiner

*Primary Examiner* — Natalie Walford
(74) *Attorney, Agent, or Firm* — Jianq Chyun IP Office

(57) ABSTRACT

An illuminating device includes a case, a heat sink block, an LED array, two waterproof plastic sheets and two covers. The case has a fluid inlet, a fluid outlet and two partition grooves. The heat sink block has a carrying platform and a fluid channel. The fluid channel is conformally disposed in the partition grooves and communicated with the fluid inlet and the fluid outlet. The LED array is located on the carrying platform. The waterproof plastic sheets respectively overlay the fluid inlet and the fluid outlet. The waterproof plastic sheets have a first opening communicated with the fluid channel. The covers respectively overlay the waterproof plastic sheet and a part of the case and have a second opening corresponding to the first opening. A fluid flows through the fluid channel via the second openings and the first openings so as to discharge heat from the LED array.

20 Claims, 4 Drawing Sheets

ILLUMINATING DEVICE CAPABLE OF WATERPROOF FUNCTION AND HEAT-DISSIPATING FUNCTION

CROSS-REFERENCE TO RELATED APPLICATION

This application claims the priority benefit of Taiwan application serial no. 98144534, filed on Dec. 23, 2009. The entirety of the above-mentioned patent application is hereby incorporated by reference herein and made a part of specification.

BACKGROUND OF THE INVENTION

1. Field of the Invention

The present invention generally relates to an illuminating device, and more particularly, it relates to an illuminating device capable of waterproof function and heat-dissipating function.

2. Description of Related Art

The light-emitting diode (LED) is a semiconductor device, mainly made of compound semiconductor materials of chemical elements of groups III-V, for example, gallium phosphide (GaP), gallium arsenide (GaAs). The compound semiconductor materials are characteristic of converting electric energy into light. In more details, when applying a current on the compound semiconductor material, the electrons and the holes in the material would be recombined and the excessive energy after the recombining would be released in light form so as to result in light-emitting effect.

In general speaking, the light-emitting phenomena of LEDs are counted as cold light emission instead of light emission resulting from heat or discharge light emission. Thereby, the lifetime of an LED can be over a hundred of thousand hours and the LED can work immediately without idling time. In addition, LEDs have many advantages, such as fast response speed (about $10^{-9}$ sec), small size, power-saving, low pollution (no mercury) and suitability for mass production. In this regard, the LEDs are applicable to various and wide fields, for example, light sources in mega-size display board, traffic light, handset, scanner or fax machine.

Since the light-emitting luminance and the light-emitting efficiency of LEDs are gaining steady advances recently and the white LEDs with high luminance have been in mass production, so that the white LEDs are gradually used in illuminating devices, for example, indoor lighting, outdoor street lamps and illumination lamps in refrigerator or in water. The LEDs with high power generally encounter a heat-dissipating problem. That is if an LED is operated in an excessive high temperature, it likely occurs that the light luminance provided by the LED gets decayed and the lifetime thereof is shortened.

Besides, when LEDs serve as illumination lamps in refrigerator or in water, except for heat-dissipating consideration, it is also considered to have waterproof effect so as to avoid moisture from electrically damaging the structure inside a lamp, in particular the problem occurring at the joint with gap between the lens and the heat sink block thereof. As the waterproof handling scheme involved in the illumination lamps in refrigerator or water currently, it is mostly adopted a processing in filling adhesive on the joint with gap between the lens and the heat sink block thereof so as to conduct a gap filling processing. However, such a processing in filling adhesive is unlikely controlled and results in a poor effect. Another adopted scheme is to make the heat sink block directly enclosed in the lens where the waterproof design is only against the side edges of the lens, wherein, however, the heat sink block directly enclosed by the lens is not easily to be heat-dissipated so that the LEDs would be operated in an excessive temperature to reduce the reliability of the LEDs. In this regard, to make a lamp adopting LEDs and having good design of heat-dissipating function and waterproof function has become one of projects attended by many developers.

SUMMARY OF THE INVENTION

Accordingly, the present invention is directed to an illuminating device having both waterproof function and heat-dissipating function.

The present invention provides an illuminating device, which includes a case, a heat sink block, an LED array, two waterproof plastic sheets and two covers. The case has a fluid inlet, a fluid outlet and two partition grooves. The heat sink block is disposed in the case and has a carrying platform and a fluid channel. The fluid channel is conformally disposed in the partition grooves and is communicated with the fluid inlet and the fluid outlet. The LED array is disposed in the case and located on the carrying platform of the heat sink block. The fluid channel is located under the LED array. The waterproof plastic sheets respectively overlay the fluid inlet and the fluid outlet. Each of the waterproof plastic sheets has a first opening. Each of the first openings is communicated with the fluid channel. The covers respectively overlay the waterproof plastic sheet and a part of the case. Each of the covers has a second opening, and the second openings are respectively corresponding to the first openings. A fluid flows through the fluid channel via the second openings and the first openings so as to discharge heat from the LED array.

In an embodiment of the present invention, the above-mentioned case includes an atomization lens or a transparent lens.

In an embodiment of the present invention, the above-mentioned case further has a pair of sliding hooks and the heat sink block further has a pair of sliding rails, and each of the sliding hooks correspondingly locks each of the sliding rails so as to make the heat sink block slide relatively to the case.

In an embodiment of the present invention, the above-mentioned LED array includes a carrier and a plurality of LEDs. The LED array is arranged on the carrier and electrically connected to the carrier.

In an embodiment of the present invention, the material of the above-mentioned covers includes metal.

In an embodiment of the present invention, the above-mentioned illuminating device further includes a plurality of fasteners. Each of the waterproof plastic sheets respectively has a plurality of first fastening holes and each of the covers respectively has a plurality of second fastening holes. The second fastening holes are respectively corresponding to the first fastening holes, the fasteners are suitable to penetrate through the second fastening holes and the first fastening holes to fasten the covers and the waterproof plastic sheets on the case.

In an embodiment of the present invention, the above-mentioned illuminating device further includes two side covers respectively disposed between the covers and the waterproof plastic sheets, and each of the side covers respectively has a plurality of third fastening holes, wherein the third fastening holes are respectively corresponding to the first fastening holes and the second fastening holes. The fasteners sequentially penetrate through the second fastening holes, the third fastening holes and the first fastening holes so as to fasten the covers, the side covers and the waterproof plastic sheets on the case.

In an embodiment of the present invention, each of the above-mentioned side covers respectively has a third opening, and the third openings are respectively corresponding to the first openings and the second openings.

In an embodiment of the present invention, the material of the above-mentioned side covers includes waterproof rubber.

In an embodiment of the present invention, the above-mentioned fasteners include screw and bolt.

In an embodiment of the present invention, the above-mentioned illuminating device further includes two fixing components, wherein each of the fixing components has a supporting portion and a clamping portion. The clamping portions are suitable to respectively clamp the cover and the supporting portions are for supporting the covers.

In an embodiment of the present invention, each of the above-mentioned fixing components further has a pivot unit connected between the supporting portion and the clamping portion so that the clamping portion rotates relatively to the supporting portion by means of the pivot unit.

In an embodiment of the present invention, at least one of the above-mentioned fixing components further has a limiting portion connected to the clamping portion and abuts against a side of the cover to limit the cover to move relatively to the fixing component.

In an embodiment of the present invention, the above-mentioned illuminating device further includes a power cord and the LED array is electrically connected to an external circuit via the power cord.

In an embodiment of the present invention, the above-mentioned fluid includes gas or liquid.

The present invention also provides an illuminating device, which includes a transparent case, a heat sink element, a light-emitting component and two sealing elements. The transparent case has two openings, the heat sink element is disposed in the transparent case and defines a first space and a second space, wherein the openings expose the first space and the second space. The light-emitting component is disposed on the heat sink element and located in the first space, and the light-emitting component is suitable to emit a light penetrating the transparent case. The sealing elements are respectively disposed on the two openings of the transparent case and are in association with the transparent case and the heat sink element to seal the first space but expose the second space serving as a heat-dissipating channel.

In an embodiment of the present invention, the above-mentioned transparent case further has a pair of sliding hooks and the heat sink element further has a pair of sliding rails, and each of the sliding hooks correspondingly locks each of the sliding rails so as to make the heat sink element slide relatively to the case.

In an embodiment of the present invention, the above-mentioned light-emitting component includes an LED array.

In an embodiment of the present invention, the above-mentioned LED array includes a carrier and a plurality of LEDs. The LED array is arranged on the carrier and electrically connected to the carrier.

In an embodiment of the present invention, the above-mentioned sealing elements include two waterproof plastic sheets, two side covers and two covers. The waterproof plastic sheets respectively overlay two openings of the transparent case and expose the second space. The side covers respectively overlay the waterproof plastic sheets and expose the second space. The covers respectively overlay the side covers, the waterproof plastic sheets and a part of the transparent cases, wherein the covers expose the second space, a fluid flows through the second space via the covers so as to discharge the heat from the light-emitting component.

In an embodiment of the present invention, the material of the above-mentioned covers includes metal.

In an embodiment of the present invention, the above-mentioned fluid includes gas or liquid.

In an embodiment of the present invention, the material of the above-mentioned side covers includes waterproof rubber.

In an embodiment of the present invention, the above-mentioned illuminating device further includes a plurality of fasteners. The sealing elements have a plurality of fastening holes and the fasteners are suitable to penetrate through the fastening holes to fasten the sealing elements on the transparent case.

In an embodiment of the present invention, the above-mentioned fasteners include screw and bolt.

In an embodiment of the present invention, the above-mentioned illuminating device further includes two fixing components, wherein each of the fixing components has a supporting portion and a clamping portion. The clamping portions are suitable to respectively clamp the sealing elements and the supporting portions are for supporting the sealing elements.

In an embodiment of the present invention, each of the above-mentioned fixing components further has a pivot unit connected between the supporting portion and the clamping portion so that the clamping portion rotates relatively to the supporting portion by means of the pivot unit.

In an embodiment of the present invention, at least one of the above-mentioned fixing components further has a limiting portion connected to the clamping portion, the limiting portion abuts against a side of the sealing element to limit the sealing element to move relatively to the fixing component.

In an embodiment of the present invention, the above-mentioned illuminating device further includes a power cord and the light-emitting component is electrically connected to an external circuit via the power cord.

The present invention also provides an illuminating device, which includes a transparent pipe, a heat-dissipating pipe, a light-emitting component and two sealing elements. The heat-dissipating pipe is disposed in the transparent pipe. The light-emitting component is disposed on the heat-dissipating pipe and located between the transparent pipe and the heat-dissipating pipe. The light-emitting component is for emitting a light to penetrate the transparent pipe. The sealing elements are respectively disposed at both ends of the transparent pipe, the sealing elements in association with the transparent pipe and the heat-dissipating pipe seal the light-emitting component and expose a channel of the heat-dissipating pipe for heat-dissipation.

In an embodiment of the present invention, the above-mentioned light-emitting component includes an LED array.

In an embodiment of the present invention, the above-mentioned LED array includes a carrier and a plurality of LEDs. The LED array is arranged on the carrier and electrically connected to the carrier.

In an embodiment of the present invention, the above-mentioned sealing elements include two waterproof plastic sheets, two side covers and two covers. The waterproof plastic sheets respectively overlay both ends of the transparent pipe and expose the channel of the heat-dissipating pipe. The side covers respectively overlay the waterproof plastic sheets and expose the channel of the heat-dissipating pipe. The covers respectively overlay the side covers, the waterproof plastic sheets and a part of the transparent cases, wherein the covers expose the channel of the heat-dissipating pipe, a fluid flows through the channel via the covers so as to discharge the heat from the light-emitting component.

In an embodiment of the present invention, the material of the above-mentioned covers includes metal.

In an embodiment of the present invention, the above-mentioned fluid includes gas or liquid.

In an embodiment of the present invention, the material of the above-mentioned side covers includes waterproof rubber.

In an embodiment of the present invention, the above-mentioned illuminating device further includes a plurality of fasteners. The sealing elements have a plurality of fastening holes and the fasteners are suitable to penetrate through the fastening holes to fasten the sealing elements on the transparent pipe.

In an embodiment of the present invention, the above-mentioned fasteners include screw and bolt.

In an embodiment of the present invention, the above-mentioned illuminating device further includes two fixing components, wherein each of the fixing components has a supporting portion and a clamping portion. The clamping portions are suitable to respectively clamp the sealing elements and the supporting portions are for supporting the sealing elements.

In an embodiment of the present invention, each of the above-mentioned fixing components further has a pivot unit connected between the supporting portion and the clamping portion so that the clamping portion rotates relatively to the supporting portion by means of the pivot unit.

In an embodiment of the present invention, at least one of the above-mentioned fixing components further has a limiting portion connected to the clamping portion, and the limiting portion abuts against a side of the sealing element to limit the sealing element to move relatively to the fixing component.

In an embodiment of the present invention, the above-mentioned illuminating device further includes a power cord and the light-emitting component is electrically connected to an external circuit via the power cord.

Based on the depiction above, the heat sink block employed by the illuminating device of the present invention has a fluid channel so that a passive heat-dissipating can be conducted by using the heat sink block and an active heat-dissipating can be conducted by using the fluid flowing through the fluid channel. As a result, the heat of the LED array is discharged and the heat-dissipating efficiency of the illuminating device is advanced. In addition, the illuminating device of the present invention also employs the waterproof plastic sheets for waterproof design, wherein when the fluid flows through the fluid channel, the LED array can be effectively avoided from suffering moisture invasion and thereby has a better waterproof effect. In other words, the illuminating device of the present invention has both good heat-dissipating function and good waterproof function.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE INVENTION

Figure 1:
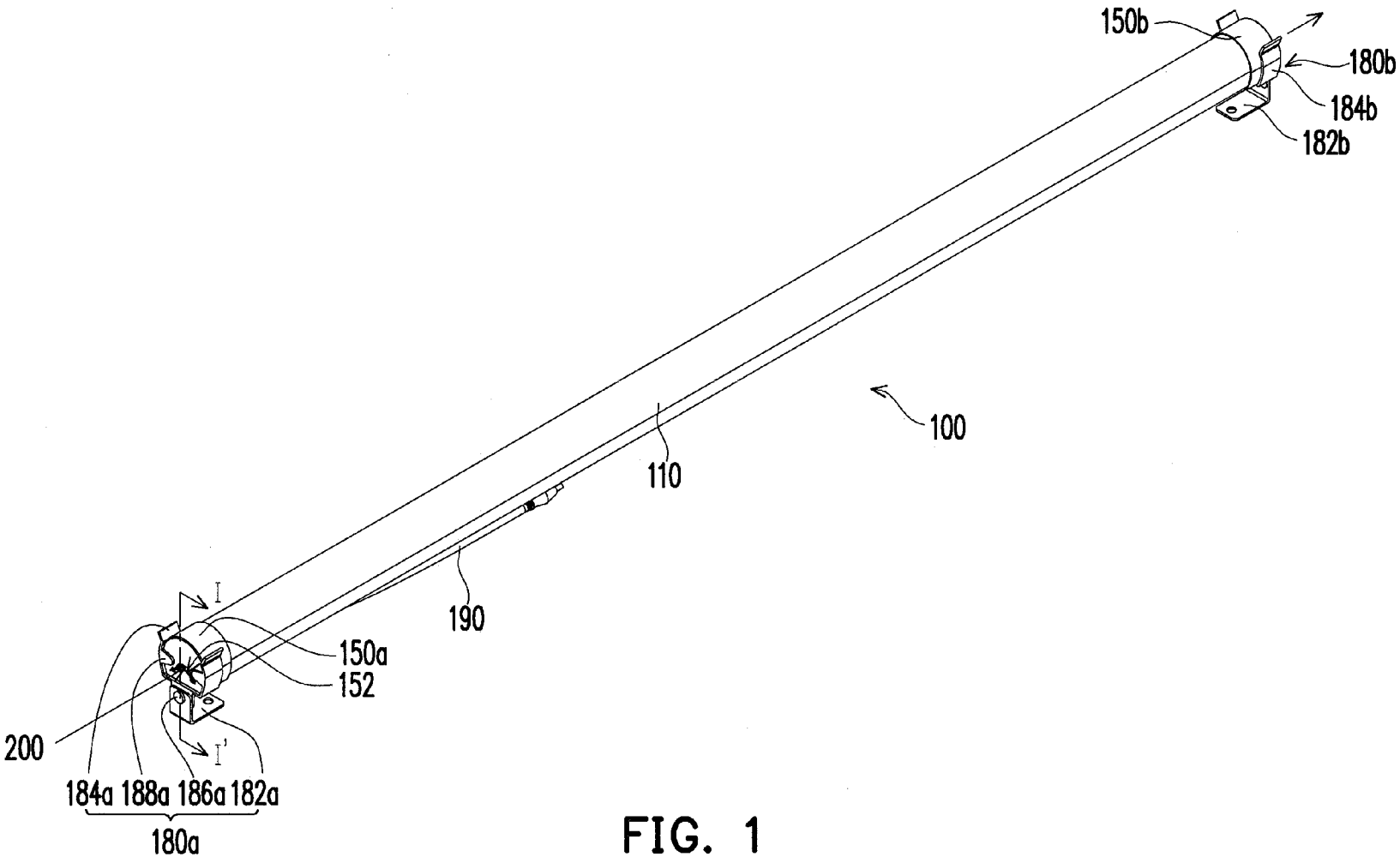
FIG. 1 is a diagram of an illuminating device according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

In the present invention, an illuminating device can include a case, a heat sink element, a light-emitting component and two sealing elements, wherein the heat sink element is disposed in the case, the light-emitting component is disposed between the case and the heat sink element, and the sealing elements in association with the case and the heat sink element seals and exposes a channel for outward heat-dissipating. In the embodiment of the present invention, the channel can be, for example, a fluid channel which is suitable to allow a fluid such as gas or liquid flowing though. The case is, for example, a transparent case or a transparent pipe. The heat sink element is, for example, a heat-dissipating pipe or a heat sink block. The light-emitting component is, for example, an LED array. The sealing element comprises, for example, two waterproof plastic sheets, two side covers and two covers. The heat of the light-emitting component can be discharged with passive heat-dissipating conducted by using the heat sink element and with active heat-dissipating through the fluid flowing through the channel, therefore the heat-dissipating efficiency of the illuminating device of the present invention is advanced. In addition, the illuminating device also take a waterproof design by employing the sealing elements, so that when the fluid flows through the channel, the light-emitting component can be effectively avoided from suffering moisture invasion and thereby has a better waterproof effect. In other words, the illuminating device of the present invention has both good heat-dissipating function and good waterproof function. In the following, an embodiment is described to explain in details the design of the illuminating device.

Figure 2:
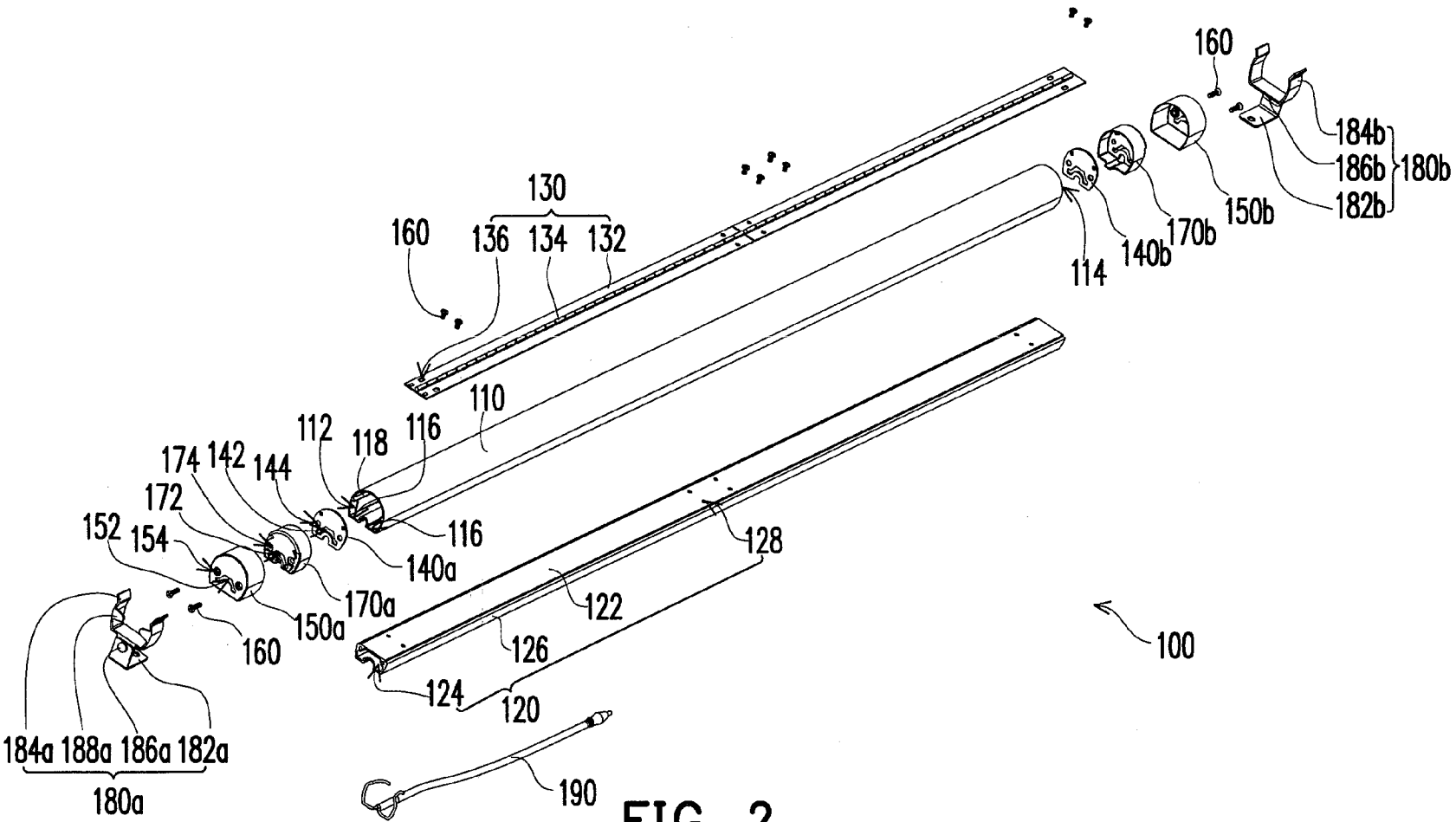
FIG. 2 is an exploded view of the illuminating device of FIG. 1.
Figure 3:
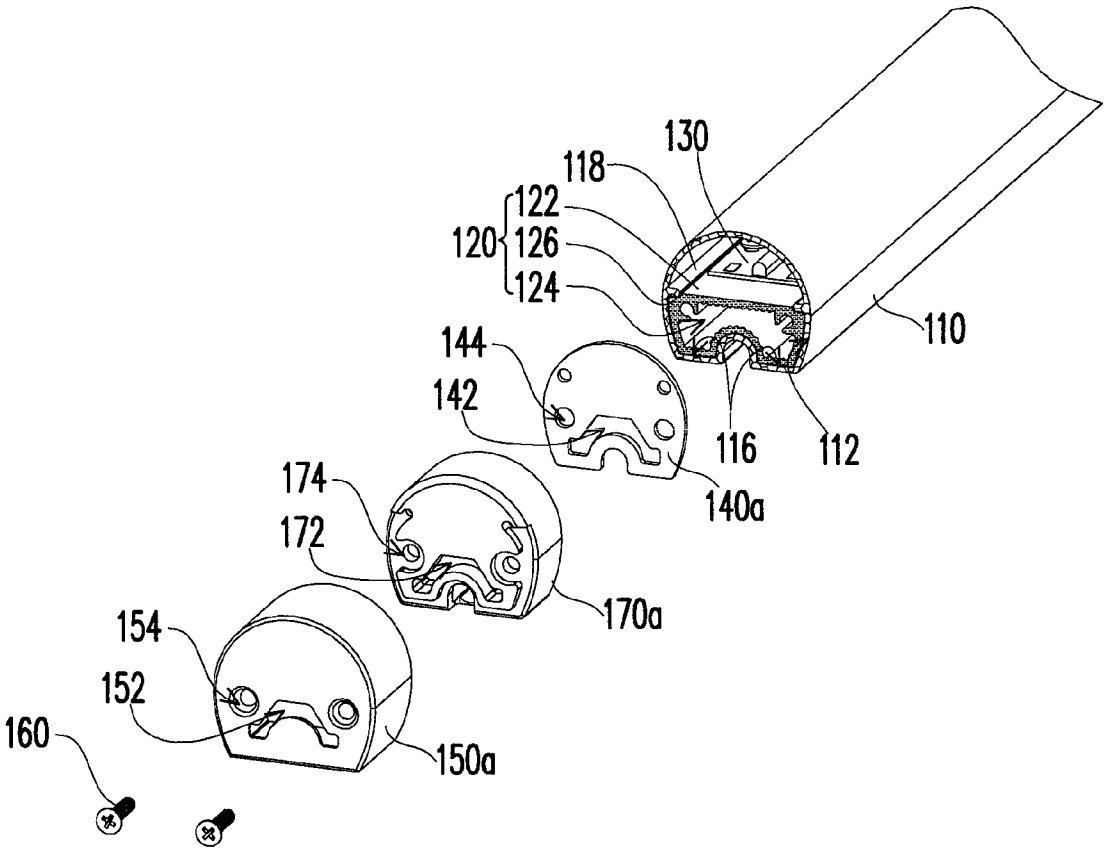
FIG. 3 is a localized enlarged diagram of partial parts in the illuminating device of FIG. 2.
Figure 4:
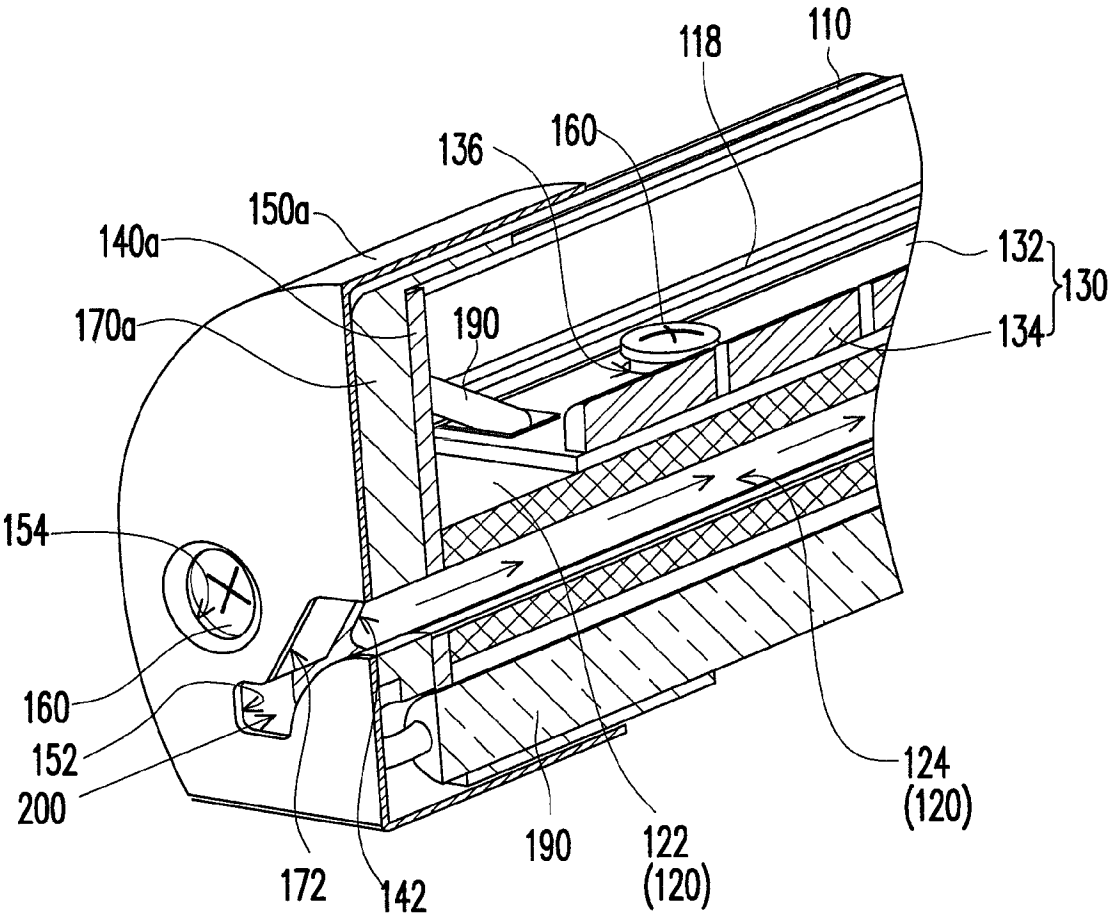
FIG. 4 is a cross-sectional diagram of FIG. 1 taken along line I-I'.

FIG. 1 is a diagram of an illuminating device according to an embodiment of the present invention, FIG. 2 is an exploded view of the illuminating device of FIG. 1, FIG. 3 is a localized enlarged diagram of partial parts in the illuminating device of FIG. 2 and FIG. 4 is a cross-sectional diagram of FIG. 1 taken along line I-I'. It should be noted that, for simplicity, the fixing components are omitted to show in FIGS. 3 and 4. Referring to FIGS. 1 and 2, in the embodiment, an illuminating device 100 includes a case 110, a heat sink block 120, an LED array 130, two waterproof plastic sheets 140*a* and 140*b* and two covers 150*a* and 150*b*.

In more details, the case 110 has a fluid inlet 112, a fluid outlet 114, two partition grooves 116 and a pair of sliding hooks 118. In the embodiment, the case 110 is, for example, an atomization lens or a transparent lens and the case has a shape of, for example, pipe, and the fluid inlet 112 and the fluid outlet 114 are opposite to each other. The partition grooves 116 and sliding hooks 118 of the case 110 can be integrally formed into one piece.

The heat sink block 120 is disposed in the case 110 and has a carrying platform 122, a fluid channel 124 and a pair of sliding rails 126. The fluid channel 124 is conformally disposed in the partition groove 116 of the case 110 and communicated with the fluid inlet 112 and the fluid outlet 114 of the case 110. In particular, the pair of sliding hooks 118 of the case 110 lock the pair of sliding rails 126 of the heat sink block 120 so that the heat sink block 120 can slide relatively to the case 110 to be disposed in the case 110 (shown in FIG.

3). In the embodiment, the carrying platform 122 and the sliding rails 126 of the heat sink block 120 can be integrally formed into one piece, and the material of the heat sink block 120 includes, for example, metal.

The LED array 130 is disposed in the case 110 and located on the carrying platform 122 of the heat sink block 120, wherein the LED array 130 includes a carrier 132 and a plurality of LEDs 134. The LEDs 134 are arranged on the carrier 132 and electrically connected to the carrier 132. In fact, prior to disposing the LED array 130 on the carrying platform 122 of the heat sink block 120, a conductive material (not shown) can be spread on the surface of the carrier 132 facing the carrying platform 122, i.e., the conductive material after spreading is located between the carrier 132 of the LED array 130 and the carrying platform 122 of the heat sink block 120. The conductive material herein is for example, conductive paste, conductive tape or other non-conductive materials, which can help increasing the heat-dissipating effect of the heat sink block 120 in addition to increasing the adhesion force between the LED array 130 and the heat sink block 120.

In the embodiment, there are a plurality of fixing holes 136 made on the carrier 132 of the LED array 130 and there are a plurality of positioning holes 128 corresponding to the fixing holes 136 made on the carrying platform 122 of the heat sink block 120. Meanwhile, the illuminating device 100 further includes a plurality of fasteners 160, which can respectively penetrate through the fixing holes 136 and the positioning holes 128 to fasten the carrier 132 of the LED array 130 on the carrying platform 122 of the heat sink block 120. In the embodiment, the fasteners 160 are, for example, screw or bolt. In particular, in the embodiment, the fluid channel 124 of the heat sink block 120 is located right under the LED array 130. Besides, the illuminating device 100 can further include a power cord 190 and the LED array 130 is electrically connected to an external circuit (not shown) via the power cord 190.

Referring to FIGS. 2 and 3, the waterproof plastic sheet 140*a* overlays the fluid inlet 112 and closely adheres the fluid inlet 112, while the waterproof plastic sheet 140*b* overlays the fluid outlet 114 and closely adheres the fluid outlet 114. Each of the waterproof plastic sheets (140*a* or 140*b*) has a first opening 142 and a plurality of first fastening holes 144, wherein the first opening 142 is communicated with the fluid channel 124, i.e., the first opening 142 of the waterproof plastic sheet 140*a*, the fluid channel 124 and the first opening 142 of the waterproof plastic sheet 140*b* are communicated with each other, referring to FIGS. 2 and 4. In other words, through the design of the waterproof plastic sheets 140*a* and 140*b*, the LED array 130 located on the carrying platform 122 of the heat sink block 120 is isolated from the fluid channel 124.

The cover 150*a* overlays the waterproof plastic sheet 140*a* and a part of the case 110 (i.e. the portion of the case 110 adjacent to the end of the fluid inlet 112), while the cover 150*b* overlays the waterproof plastic sheet 140*b* and a part of the case 110 (i.e. the portion of the case 110 adjacent to the end of the fluid outlet 114). In the embodiment, each cover (150*a* or 150*b*) has a second opening 152 and a plurality of second fastening holes 154, wherein the second openings 152 are respectively corresponding to the first openings 142 and communicated with the fluid channel 124, which means the second opening 152 of the cover 150*a*, the first opening 142 of the waterproof plastic sheet 140*a*, the fluid channel 124, first opening 142 of the waterproof plastic sheet 140*b* and the second opening 152 of the cover 150*b* are communicated with each other (referring to FIGS. 2 and 4). In addition, the second fastening holes 154 of the covers 150*a* and 150*b* are respectively corresponding to the first fastening holes 144 of the waterproof plastic sheets 140*a* and 140*b*. The material of the covers 150*a* and 150*b* includes metal.

In order to enhance the waterproof effect, the illuminating device 100 of the embodiment further includes two side covers 170*a* and 170*b*, wherein the side cover 170*a* is disposed between the cover 150*a* and the waterproof plastic sheet 140*a*, while the side cover 170*b* is disposed between the cover 150*b* and the waterproof plastic sheet 140*b*. In the embodiment, each of the side covers (170*a* or 170*b*) has a third opening 172 and a plurality of third fastening holes 174, wherein the third openings 172 are respectively corresponding to the first opening 142 and the second opening 152 and communicated with the fluid channel 124, which means the second opening 152 of the cover 150*a*, the third opening 172 of the side cover 170*a*, first opening 142 of the waterproof plastic sheet 140*a*, the fluid channel 124, the first opening 142 of the waterproof plastic sheet 140*b*, the third opening 172 of the side cover 170*b* and the second opening 152 of the cover 150*b* are communicated with each other (referring to FIGS. 2 and 4). Besides, the third fastening holes 174 of the side cover 170*a* and the side cover 170*b* are respectively corresponding to the first fastening holes 144 of the waterproof plastic sheets 140*a* and 140*b* and the second fastening holes 154 of the covers 150*a* and 150*b*. The fasteners 160 sequentially penetrate through the second fastening holes 154, the third fastening holes 174 and the first fastening holes 144 and tightly fasten the covers 150*a* and 150*b*, the side covers 170*a* and 170*b* and the waterproof plastic sheets 140*a* and 140*b* on the case 110, wherein the material of the side covers 170*a* and 170*b* includes waterproof rubber.

Continuing to FIGS. 1 and 4, in the embodiment, it should be noted that a fluid 200 can flow from the fluid inlet 112 of the cover 110 to the fluid channel 124 sequentially through the second opening 152 of the cover 150*a*, the third opening 172 of the side cover 170*a* and the first opening 142 of the waterproof plastic sheet 140*a*. Then, the fluid 200 with the heat of the LED array 130 together flows from the fluid outlet 114 of the case 110 sequentially through the first opening 142 of the waterproof plastic sheet 140*b*, the third opening 172 of the side cover 170*b* and the second opening 152 of the cover 150*b* so that the heat of the LED array 130 is discharged. The fluid 200 herein is, for example, gas or liquid. Since the fluid channel 124 of the embodiment is located under the LED array 130 so that the illuminating device 100 of the embodiment can conduct both passive heat-dissipating and the active heat-dissipating, wherein the passive heat-dissipating is realized by the heat sink block 120 and the active heat-dissipating is realized by the fluid 200 flowing through the fluid channel 124. In this way, the heat-dissipating efficiency of the illuminating device 100 is advanced.

Through the design of the waterproof plastic sheets 140*a* and 140*b* of the embodiment, the LED array 130 located on the carrying platform 122 of the heat sink block 120 can be effectively isolated from the fluid channel 124, and the waterproof plastic sheets 140*a* and 140*b* herein have also the first openings 142 communicated with the fluid channel 124. In this way, when the fluid 200 flows through the fluid channel 124, in addition to that the LED array 130 can be effectively prevented from suffering moisture invasion, the active heat-dissipating is also conducted by the fluid 200 flowing through the fluid channel 124. In other words, the illuminating device 100 of the embodiment has a better heat-dissipating effect and a better waterproof effect. It should be noted that in a waterproof experiment of the waterproof plastic sheets 140*a* and 140*b* of the embodiment, the illuminating device 100 is preferably placed at a 1000 mm level under from the water surface keeping continuously for 30 min., the moisture does not invade LED array 130. In short, the illuminating device 100 of the embodiment has a better heat-dissipating effect and a better waterproof effect.

Referring to FIGS. 1 and 2, in the embodiment, the illuminating device 100 further has two fixing components 180*a* and 180*b*, wherein the fixing component 180*a* has a supporting portion 182*a*, a clamping portion 184*a*, a pivot unit 186*a* and a limiting portion 188*a*. The fixing component 180*b* has a supporting portion 182*b*, a clamping portion 184*b* and a pivot unit 186*b*. In more details, the clamping portions 184*a* and 184*b* are suitable to respectively clamp the covers 150*a* and 150*b*, and the supporting portions 182*a* and 182*b* are for supporting the covers 150*a* and 150*b*. The pivot units 186*a* and 186*b* are respectively connected between the supporting portion 182*a* and the clamping portion 184*a* and between the supporting portion 182*b* and the clamping portion 184*b* so that the clamping portions 184*a* and 184*b* can respectively rotate relatively to the supporting portions 182*a* and 182*b* through the pivot units 186*a* and 186*b* and thereby the placing orientation of the illuminating device 100 can be changed. The limiting portion 188*a* is connected to the clamping portion 184*a*. When the clamping portions 184*a* and 184*b* respectively clamp the covers 150*a* and 150*b*, the limiting portion 188*a* of the fixing component 180*a* would abut against a side of the cover 150*a* to limit the moving of the cover 150*a* relatively to the fixing component 180*a*. At the time, another fixing component 180*b* is able to make the clamping portion 184*b* moving relatively to the cover 150*b* to a required position according to the application need by adjusting the clamping portion 184*b*.

It should be noted that the present invention does not limit the implementation structure of the fixing components 180*a* and 180*b*, although the fixing component 180*a* herein is implemented by a combination structure of the supporting portion 182*a*, the clamping portion 184*a*, the pivot unit 186*a* and the limiting portion 188*a* and the fixing component 180*b* herein is implemented by a combination structure of the supporting portion 182*b*, the clamping portion 184*b* and the pivot unit 186*b*. Any known structure able to have the same fixing effect still falls in the technical scheme adopted by the present invention without departing from the scope of the invention. In other words, in other unshown embodiments, anyone skilled in the art can select in their wills the above-mentioned structure according to the application need so as to reach the required technical effect.

In summary, the heat sink block employed by the illuminating device of the present invention has a fluid channel so that a passive heat-dissipating can be conducted by using the heat sink block and an active heat-dissipating can be conducted by using the fluid flowing through the fluid channel. As a result, the heat of the LED array is discharged and the heat-dissipating efficiency of the illuminating device is advanced. In addition, the illuminating device of the present invention also employs the waterproof plastic sheets for waterproof design, wherein when the fluid flows through the fluid channel, the LED array can be effectively avoided from suffering moisture invasion and thereby has a better waterproof effect. In other words, the illuminating device of the present invention has both good heat-dissipating function and good waterproof function.

It will be apparent to those skilled in the art that the descriptions above are several preferred embodiments of the present invention only, which does not limit the implementing range of the present invention. Various modifications and variations can be made to the structure of the present invention without departing from the scope or spirit of the invention.

What is claimed is:

1. An illuminating device, comprising:

a case including a fluid inlet, a fluid outlet and two partition grooves;

a heat sink block slidably disposed in the case, wherein the heat sink block includes a carrying platform and a fluid channel, the fluid channel is conformally disposed in the partition grooves and is communicated with the fluid inlet and the fluid outlet;

a light-emitting diode array disposed in the case and located on the carrying platform of the heat sink block, wherein the fluid channel is located under the light-emitting diode array;

two waterproof plastic sheets, respectively overlaying the fluid inlet and the fluid outlet, wherein each of the waterproof plastic sheet has a first opening and each of the first openings is communicated with the fluid channel; and two covers, respectively overlaying the waterproof plastic sheet and a part of the case, wherein each of the covers has a second opening, and the second openings are respectively corresponding to the first openings, a fluid flows through the fluid channel via the second openings and the first openings so as to discharge heat from the light-emitting diode array.

2. The illuminating device of claim 1, wherein the case further includes a pair of sliding hooks and the heat sink block further includes a pair of sliding rails, each of the sliding hooks correspondingly locks each of the sliding rails so as to make the heat sink block slide relatively to the case.

3. The illuminating device of claim 1, further comprising a plurality of fasteners, wherein each of the waterproof plastic sheets respectively comprises a plurality of first fastening holes and each of the covers respectively comprises a plurality of second fastening holes, wherein the second fastening holes are respectively corresponding to the first fastening holes, the fasteners are suitable to penetrate through the second fastening holes and the first fastening holes to fasten the covers and the waterproof plastic sheets on the case.

4. The illuminating device of claim 3, further comprising two side covers, respectively disposed between the covers and the waterproof plastic sheets, each of the side covers respectively includes a plurality of third fastening holes respectively corresponding to the first fastening holes and the second fastening holes, and the fasteners sequentially penetrate through the second fastening holes, the third fastening holes and the first fastening holes so as to fasten the covers, the side covers and the waterproof plastic sheets on the case.

5. The illuminating device of claim 4, wherein each of the side covers respectively comprises a third opening, and the third openings are respectively corresponding to the first openings and the second openings.

6. The illuminating device of claim 1, further comprising two fixing components, wherein each of the fixing components includes a supporting portion and a clamping portion, wherein the clamping portions are suitable to respectively clamp the covers and the supporting portions are for supporting the covers.

7. The illuminating device of claim 6, wherein each of the fixing components further includes a pivot unit connected between the supporting portion and the clamping portion so that the clamping portion rotates relatively to the supporting portion by means of the pivot unit.

8. The illuminating device of claim 6, wherein at least one of the fixing components further includes a limiting portion connected to the clamping portion and abuts against a side of the cover to limit the cover to move relatively to the fixing component.

9. An illuminating device, comprising:

a transparent case including two openings;

a heat sink element slidably disposed in the transparent case, wherein the heat sink element defines a first space and a second space, the openings expose the first space and the second space;

a light-emitting component disposed on the heat sink element and located in the first space, wherein the light-emitting component is suitable to emit a light penetrating the transparent case; and two sealing elements having two waterproof plastic sheets, respectively disposed on the two openings of the transparent case, wherein the sealing elements in association with the transparent case and the heat sink element seal the first space but expose the second space serving as a heat-dissipating channel, and the two waterproof plastic sheets respectively overlay the two openings of the transparent case and expose the second space.

10. The illuminating device of claim 9, wherein the transparent case further includes a pair of sliding hooks and the heat sink element further includes a pair of sliding rails, each of the sliding hooks correspondingly locks each of the sliding rails so as to make the heat sink element slide relatively to the case.

11. The illuminating device of claim 9, wherein the sealing elements further comprise:

two side covers, respectively overlaying the waterproof plastic sheets and exposing the second space; and two covers, respectively overlaying the side covers, the waterproof plastic sheets and a part of the transparent case, wherein the covers expose the second space, a fluid flows through the second space via the covers so as to discharge the heat from the light-emitting component.

12. The illuminating device of claim 9, further comprising two fixing components, wherein each of the fixing components includes a supporting portion and a clamping portion, the clamping portions are suitable to respectively clamp the sealing elements and the supporting portions are for supporting the sealing elements.

13. The illuminating device of claim 12, wherein each of the fixing components further includes a pivot unit connected between the supporting portion and the clamping portion so that the clamping portion rotates relatively to the supporting portion by means of the pivot unit.

14. The illuminating device of claim 12, wherein at least one of the fixing components further includes a limiting portion connected to the clamping portion, the limiting portion abuts against a side of the sealing element to limit the sealing element to move relatively to the fixing component.

15. An illuminating device, comprising:

a transparent pipe;

a heat-dissipating pipe slidably disposed in the transparent pipe;

a light-emitting component disposed on the heat-dissipating pipe and located between the transparent pipe and the heat-dissipating pipe, wherein the light-emitting component is for emitting a light to penetrate the transparent pipe; and two sealing elements having two waterproof plastic sheets, respectively disposed at both ends of the transparent pipe, wherein the sealing elements in association with the transparent pipe and the heat-dissipating pipe seal the light-emitting component and expose a channel of the heat-dissipating pipe for heat-dissipation, and the two waterproof plastic sheets respectively overlay both ends of the transparent pipe and expose the channel of the heat-dissipating pipe.

16. The illuminating device of claim 15, wherein the sealing elements further comprise:

two side covers, respectively overlaying the waterproof plastic sheets and exposing the channel of the heat-dissipating pipe; and two covers, respectively overlaying the side cover, the waterproof plastic sheet and a part of the transparent case, wherein the covers expose the channel of the heat-dissipating pipe, and a fluid flows through the channel via the covers so as to discharge the heat from the light-emitting component.

17. The illuminating device of claim 15, further comprising a plurality of fasteners, wherein the sealing elements have a plurality of fastening holes and the fasteners are suitable to penetrate through the fastening holes to fasten the sealing elements on the transparent pipe.

18. The illuminating device of claim 15, further comprising two fixing components, wherein each of the fixing components includes a supporting portion and a clamping portion, wherein the clamping portions are suitable to respectively clamp the sealing elements and the supporting portions are for supporting the sealing elements.

19. The illuminating device of claim 18, wherein each of the fixing components further includes a pivot unit connected between the supporting portion and the clamping portion so that the clamping portion rotates relatively to the supporting portion by means of the pivot unit.

20. The illuminating device of claim 18, wherein at least one of the fixing components further includes a limiting portion connected to the clamping portion, and the limiting portion abuts against a side of the sealing element to limit the sealing element to move relatively to the fixing component.

* * * * *